US007537318B2

(12) United States Patent
Fujii et al.

(10) Patent No.: US 7,537,318 B2
(45) Date of Patent: May 26, 2009

(54) INK JET PRINT HEAD, INK JET PRINTING APPARATUS, AND METHOD FOR MANUFACTURING INK JET PRINT HEAD

(75) Inventors: Tomohiro Fujii, Matsudo (JP); Hiroyuki Ishinaga, Tokyo (JP); Kayo Mukai, Tokyo (JP)

(73) Assignee: Canon Finetech Inc., Misato-shi (JP)

( * ) Notice: Subject to any disclaimer, the term of this patent is extended or adjusted under 35 U.S.C. 154(b) by 378 days.

(21) Appl. No.: 11/334,450

(22) Filed: Jan. 19, 2006

(65) Prior Publication Data

US 2006/0164477 A1 Jul. 27, 2006

(30) Foreign Application Priority Data

Jan. 21, 2005 (JP) ..... 2005-014561

(51) Int. Cl.
*B41J 2/045* (2006.01)
*B41J 2/19* (2006.01)

(52) U.S. Cl. ..... 347/66; 347/93

(58) Field of Classification Search ..... 347/63, 347/65, 66, 85, 87, 92, 93
See application file for complete search history.

(56) References Cited

U.S. PATENT DOCUMENTS 5,457,485 A * 10/1995 Moriyama et al. ..... 347/92
5,495,272 A 2/1996 Yamaguchi
5,561,448 A * 10/1996 Kaneko et al. ..... 347/29
6,120,136 A 9/2000 Sugiyama et al.
6,120,140 A * 9/2000 Hirosawa et al. ..... 347/93
6,158,855 A * 12/2000 Saikawa ..... 347/93
6,179,412 B1 1/2001 Ishinaga et al.
6,199,972 B1 3/2001 Ishinaga et al.
6,250,752 B1 * 6/2001 Tajima et al. ..... 347/92
6,296,352 B1 * 10/2001 Hollands et al. ..... 347/86
6,447,093 B1 9/2002 Asakawa et al.
6,805,437 B2 10/2004 Yamanaka et al.
6,932,462 B2 * 8/2005 Watanabe ..... 347/65

FOREIGN PATENT DOCUMENTS

CN 1374196 10/2002

OTHER PUBLICATIONS

Chinese Office Action in corresponding Chinese Patent Application No. 200610006401.3 dated Jun. 13, 2008.

* cited by examiner

*Primary Examiner*—Anh T. N. Vo
(74) *Attorney, Agent, or Firm*—Fitzpatrick, Cella, Harper & Scinto

(57) ABSTRACT

Ink is smoothly supplied so as to increase ink ejection speed to achieve high-speed printing. Thus, a filter is used to partition an ink storing chamber into a first and second storing chambers. Ink stored in the first storing chamber is supplied to a common liquid chamber in an ejection element. Ink introduced into the second ink storing chamber through a joint is supplied to the first storing chamber through the filter. An ink storing chamber member is joined to an ink storing chamber cover member to form the first and second ink storing chambers partitioned by the filter.

8 Claims, 18 Drawing Sheets

INK JET PRINT HEAD, INK JET PRINTING APPARATUS, AND METHOD FOR MANUFACTURING INK JET PRINT HEAD

This application claims priority from Japanese Patent Application No. 2005-014561 filed Jan. 21, 2005, which is hereby incorporated by reference herein.

BACKGROUND OF THE INVENTION

1. Field of the Invention

The present invention relates to an ink jet print head that can eject ink from ejection openings, an ink jet printing apparatus using the ink jet print head, and a method for manufacturing the ink jet print head.

2. Description of the Related Art

In an ink jet printing system, an ink jet print head that can eject ink is used to attach ink droplets ejected by the print head to a print medium such as paper. The ink jet printing system makes only very low noise and enables high-speed printing. The ink jet printing system also enables ordinary paper to be printed. Among such ink jet print heads, those using heating elements as energy generators for ejecting ink have recently been gathering much attention because of the ease with which these print heads enable the integration of a large number of energy generators.

FIG. 12 is a front view illustrating a conventional example of a print head using such heating elements. FIG. 13 is an exploded perspective view of a peripheral part of the print head as viewed from a rear surface of the print head. FIG. 14 is an enlarged sectional view taken along line XIV-XIV in FIG. 12. FIG. 15 is an enlarged view of a rectangular part shown by an arrow XV in FIG. 14. FIG. 16 is an enlarged view of a rectangular part shown by an arrow XVI in FIG. 15.

The ink jet print head comprises an ejection element 1150 provided at its leading end (lower end in FIGS. 12 and 13) as shown in FIGS. 15 and 16. A plurality of ejection openings 1151 (see FIG. 16) are formed between an Si (silicon single crystal) board 1160 and a top board 1165 constituting the ejection element 1150; the plurality of ejection openings 1151 are formed in a line in a lateral direction in FIG. 12, and ink can be ejected from the ejection openings 1151 in the direction of an arrow g. Each of the ejection openings 1151 is in communication with a common liquid chamber 1153 through a corresponding liquid channel 1152. Each of the liquid channels 1152 is provided with an electrothermal converter (heater) 1154 as an energy generating element.

The ejection element 1150 is positioned and bonded on a radiating ceramic plate 1110, on which an electric wiring board 1120 is mounted. The electric wiring board 1120 is electrically connected to the ejection element 1150 by an electric wire 1190.

As shown in FIG. 15, an ink storing chamber 1214 is formed at the bottom of an ink storing case 1200 shown in FIGS. 12 and 13; the ink storing chamber 1214 is in communication with a supply port 1150 in the ejection element 1150. As shown in FIG. 13, a joint case 1300 includes a joint 1219 connected to an external ink supply device (not shown). The joint 1219 comprises an inlet filter 1215 and an outlet filter 1216. A joint cover 1218 is welded to the joint 1219. The joint 1219 and the ink storing chamber 1214 are in communication with each other through pipes 1301 and 1302. The ink storing case 1200 is coupled to the joint case 1300 to construct an ink channel chamber 1210 as shown in FIG. 12.

The ink channel member 1210 is coupled to the ejection element 1150, positioned on the ceramic plate 1110, to construct an ink jet print head.

Ink flows as described below through the print head configured as described above.

Ink supplied by an external ink supply device is introduced into an input joint 1240 from the direction of an arrow a in FIGS. 12 and 13. The ink then flows in the direction of arrows b and c in FIG. 17 while being filtered by the inlet filter 1215. Further, the ink flows from the direction of an arrow d in FIG. 18 through a pipe 1301 into the ink storing chamber 1214. FIG. 17 is an enlarged plan view of a portion on which the joint cover 1218 in the joint case 1300 is mounted. FIG. 18 is a sectional view taken along line XVIII-XVIII in FIG. 17. Ink ejected by the print head is supplied from the ink storing chamber 1214 to the interior of the common liquid chamber 1153 along the direction of an arrow e in FIGS. 15 and 16. The ink is introduced into the liquid channel 1152 along the direction of an arrow f.

Ink not supplied from the ink storing chamber 1214 to the common liquid chamber 1153 flows through the ink storing chamber 1214 in the direction of an arrow h in FIG. 13. The ink flows through the pipe 1302 and through the outlet filter 1216 from the direction of an arrow i in FIG. 18. The ink flows in the directions of arrows j and k in FIG. 17 and through the output joint 1245. The ink is then discharged in the direction of an arrow l in FIG. 18 and returned to the external ink supply device. The ink returned to the external ink supply device is supplied to the print head again. Such ink flow causes bubbles in the ink storing chamber 1214 to be washed away from the print head. Consequently, the print head can always eject ink optimally.

However, the conventional print head described above may present the following problems.

(1) The speed at which the ink jet print head ejects ink depends directly on the performance of the printing apparatus. To improve the ink ejection speed, it is necessary to smoothly supply ink to the interior of the common liquid chamber 1153 and liquid channel 1152. The directions of the arrows e and f in FIG. 16 directly affect the ink supply. Further, the area of the inlet filter 1215 must be increased.

However, an increase in the area of the inlet filter 1215 correspondingly increases the size of a joint portion of the joint case 1300. This increases the size of the whole print head. Further, the ink flow from the joint case 1300 into the common liquid chamber 1153 is bent to offer a large flow resistance to the ink flow. Thus, with a high driving frequency with which ink is ejected, the ink supply may be delayed to preclude the ink from being ejected.

(2) The print head has a large number of joining portions formed by the ink channel and which must be inspected. This degrades the efficiency of assembly operations. The joining portions include, for example, the thermally welded portions between the joint case 1300 and the filters 1215 and 1216 and the joining portions of the pipes 1301 and 1302, which communicate between the ink storing chamber case 1200 and the joint case 1300.

SUMMARY OF THE INVENTION

It is an object of the present invention to provide an ink jet print head that smoothly supplies ink to make it possible to increase ink ejection speed to achieve high-speed printing, as well as an ink jet printing apparatus using the ink jet print head and a method for manufacturing the ink jet print head.

It is another object of the present invention to provide an ink jet print head that can be assembled easily and efficiently, as well as an ink jet printing apparatus using the ink jet print head and a method for manufacturing the ink jet print head.

In a first aspect of the present invention, there is provided an ink jet print head in which ink is supplied from an ink introducing section to a common liquid chamber through an ink storing chamber and in which the ink supplied to the common liquid chamber can be ejected from ejection openings, the print head comprising:

a filter that partitions the ink storing chamber into first and second ink storing chambers, wherein the first ink storing chamber supplies the ink stored inside the first ink storing chamber to the common liquid chamber, and the second ink storing chamber supplies the ink introduced from the ink introducing section, to the first ink storing chamber through the filter.

In a second aspect of the present invention, there is provided an ink jet printing apparatus comprising:

moving means for relatively moving the ink jet print head described above and a print medium; and control means for ejecting ink from the ejection openings in the ink jet print head.

In a third aspect of the present invention, there is provided a method for manufacturing an ink jet print head that can eject ink from ejection openings, the ink being supplied to a common liquid chamber through an ink input section, a second ink storing chamber, a filter, and a first ink storing chamber, the method comprising the step of:

joining a first storing chamber member for forming the first ink storing chamber to a second storing chamber member for forming the second ink storing chamber, to form the first and second ink storing chambers partitioned by the filter.

According to the present invention, the filter partitions the ink storing chamber into the first and second ink storing chambers. Ink stored in the first ink storing chamber is supplied to the common liquid chamber. Ink introduced from the ink introducing section into the second ink storing chamber is supplied to the first ink storing chamber through the filter. This makes it possible to provide a large-area filter to reduce ink flow resistance. The ink can thus be smoothly supplied. It is therefore possible to increase the speed at which the ink is ejected from ejection openings in the ink jet print head, thus achieving high-speed printing.

Further, the first and second storing chamber members are joined together to form the first and second ink storing chambers partitioned by the filter. This improves the operability of assembly of the ink jet print head.

The above and other objects, effects, features and advantages of the present invention will become more apparent from the following description of embodiments thereof taken in conjunction with the accompanying drawings.

DETAILED DESCRIPTION OF THE PREFERRED EMBODIMENT

An embodiment of the present invention will be described with reference to the drawings.

Figure 10:
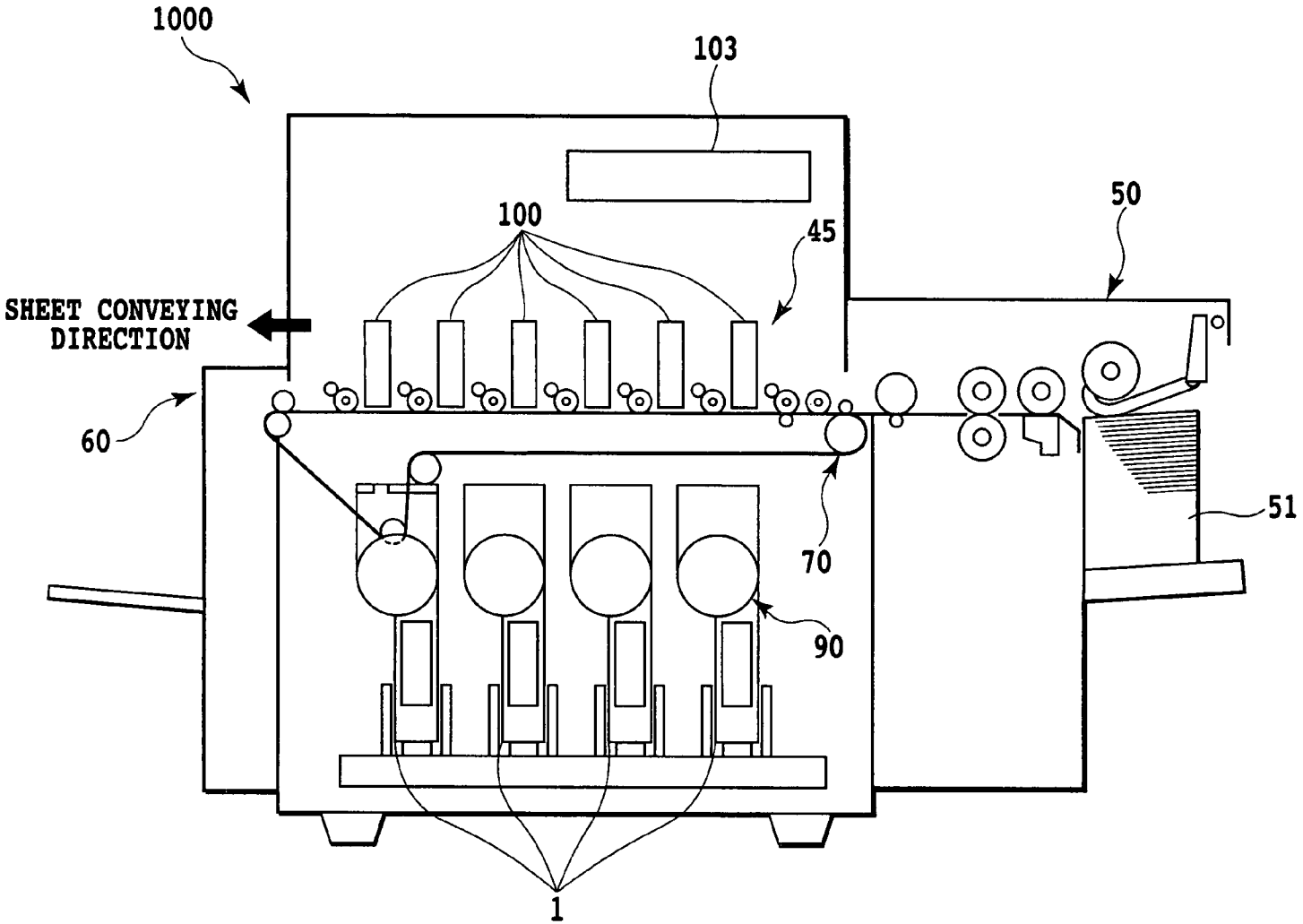
FIG. 10 is a schematic diagram of a printing apparatus to which the print head in FIG. 1 is applicable.

FIG. 10 is a schematic diagram showing the configuration of an ink jet printing apparatus 1000 that can print full-color images, as an example of a printing apparatus to which an ink jet print head in accordance with the present invention is applicable.

The printing apparatus 1000 in the present example comprises an ink jet print head 100, a sheet feeding device 50, a sheet discharging device 60, an image forming section 45, a conveying device 70, an ink tank 1, and an ink supply device 90. A sheet 51 as a print medium is supplied to the conveying device 70 by the sheet feeding device 50. The conveying device 70 then conveys the sheet 51, which thus passes by the position of the image forming section 45. The image forming section 45 prints an image containing characters, pictures, or the like on the sheet 51 by ejecting ink from the print head 100 on the basis of an instruction from a control unit 103 or the like. The sheet 51 on which the image has been printed continues to be conveyed by the conveying device 70. The sheet 51 is then placed on the sheet discharging device 60.

Figure 11:
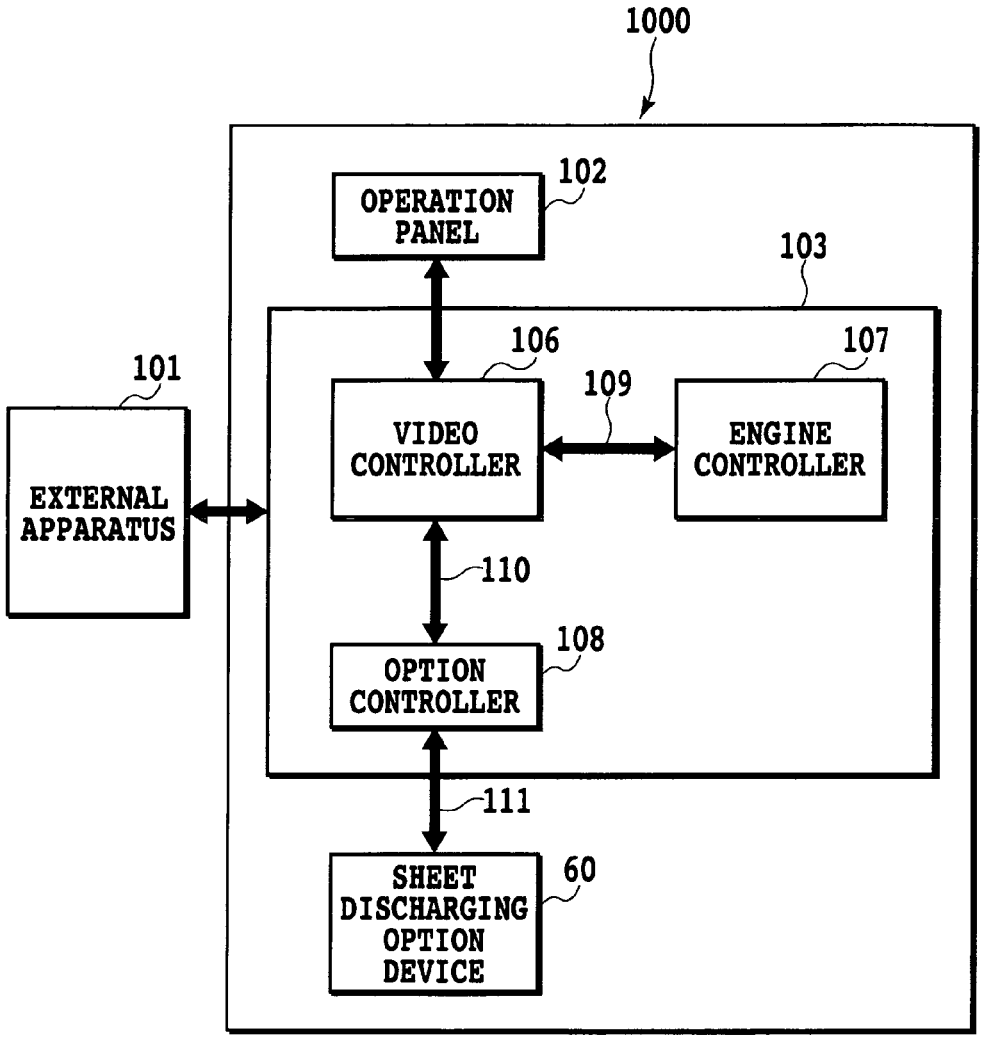
FIG. 11 is a block diagram of a control system in the printing apparatus in FIG. 10.
Figure 12:
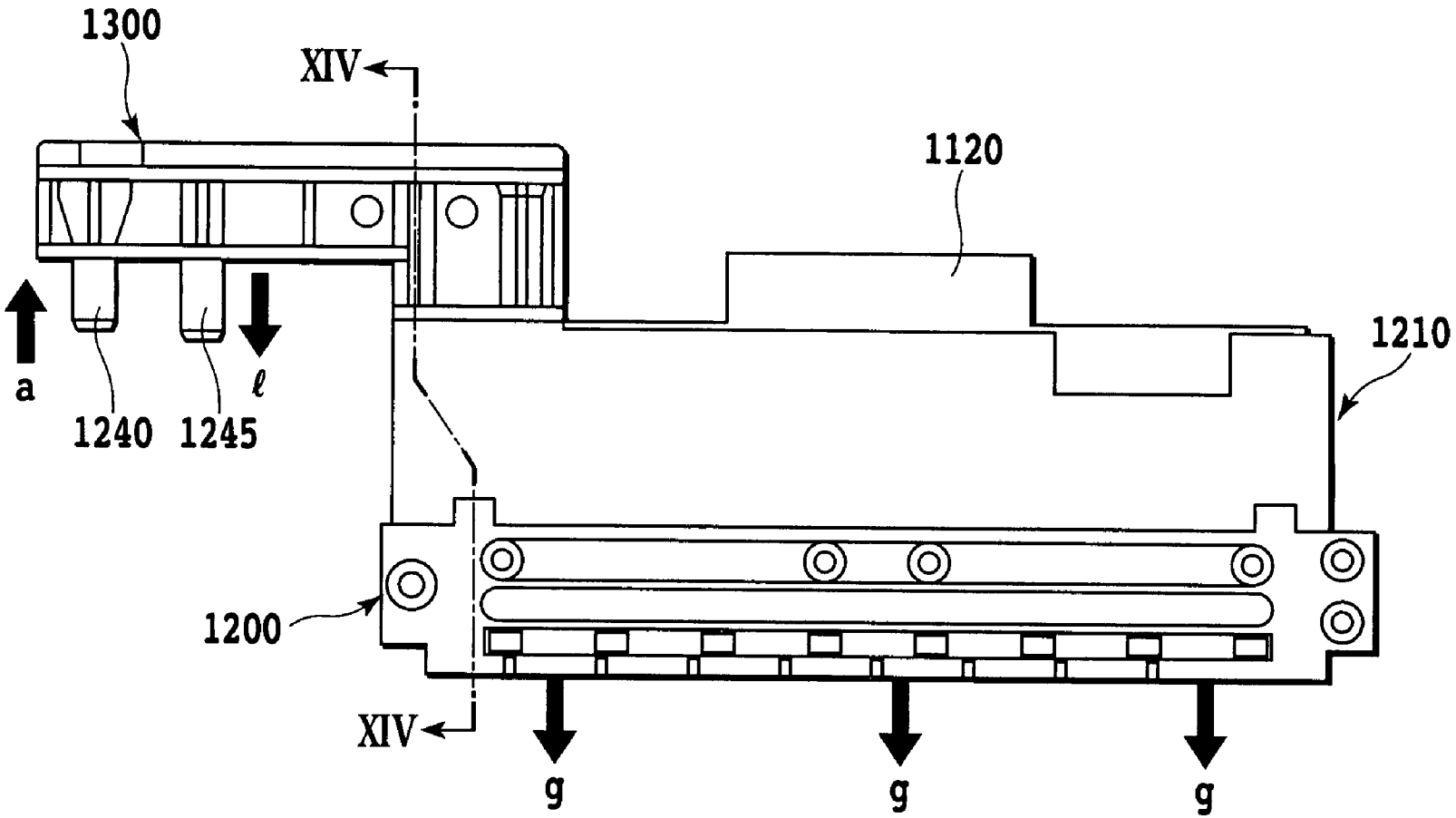
FIG. 12 is a front view of a conventional print head.
Figure 13:
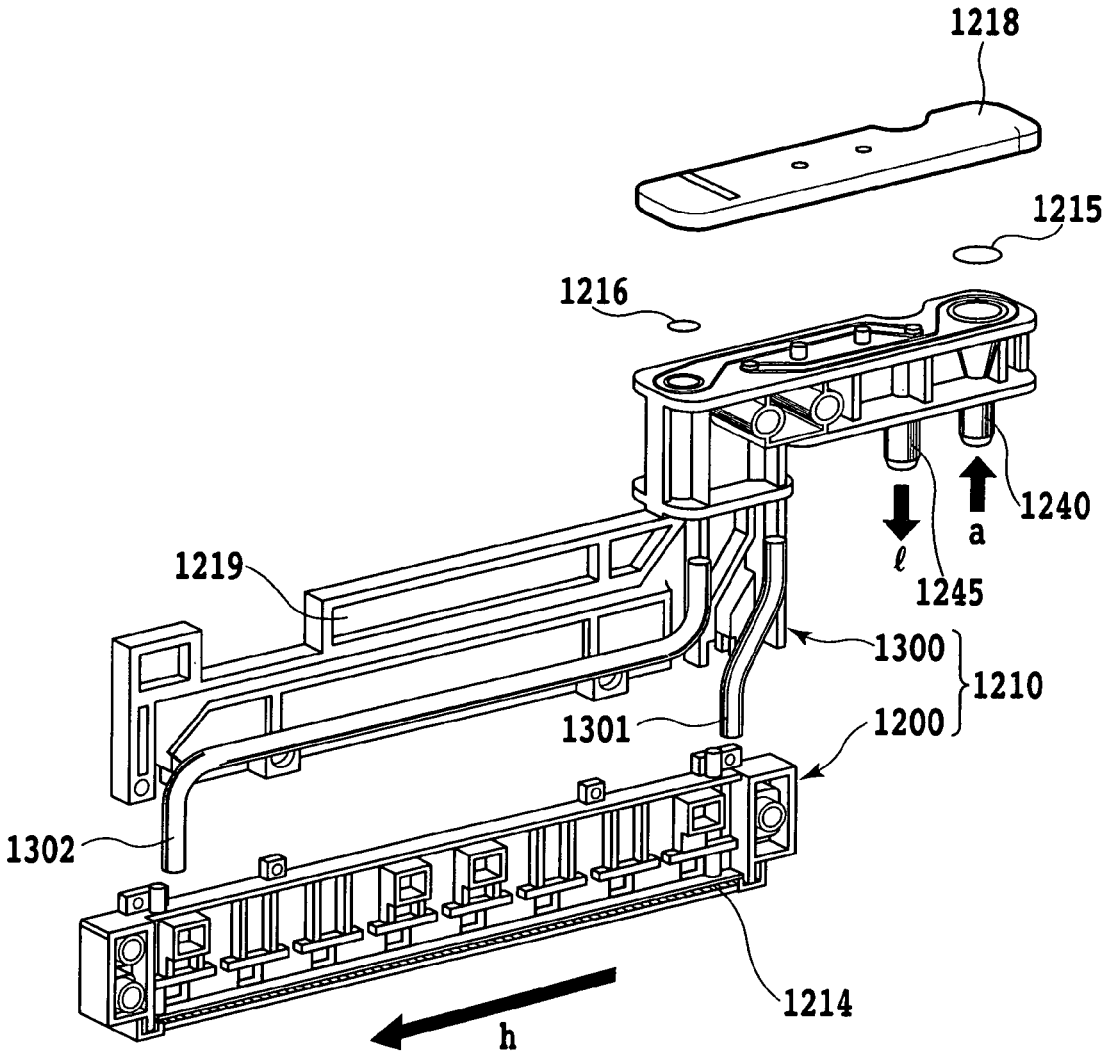
FIG. 13 is an exploded perspective view of the print head in FIG. 12.
Figure 14:
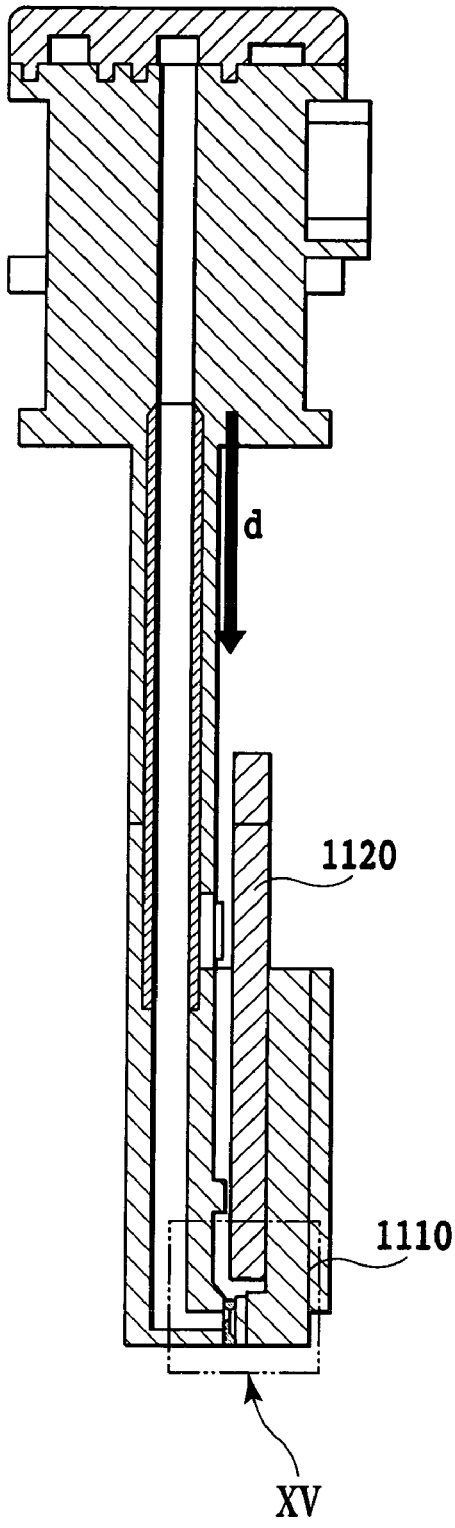
FIG. 14 is an enlarged sectional view taken along line XIV-XIV in FIG. 12.
Figure 15:
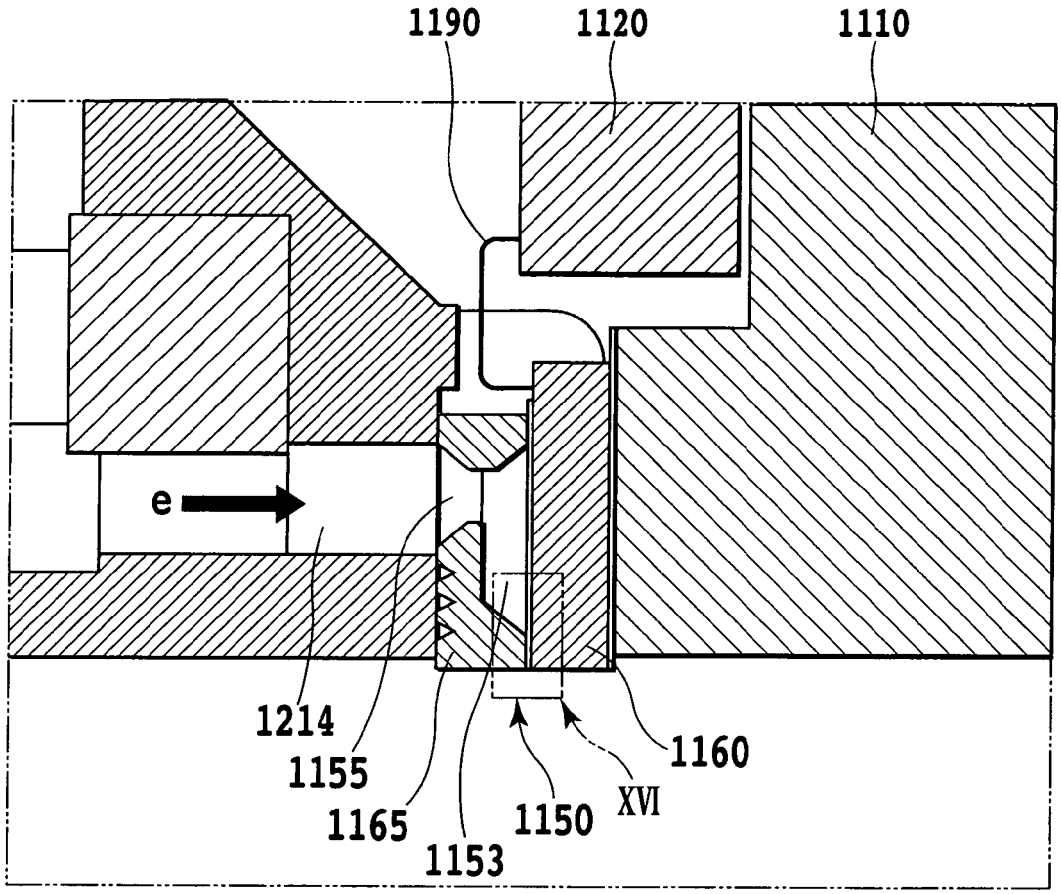
FIG. 15 is an enlarged view of a rectangular part shown by an arrow XV in FIG. 14.
Figure 16:
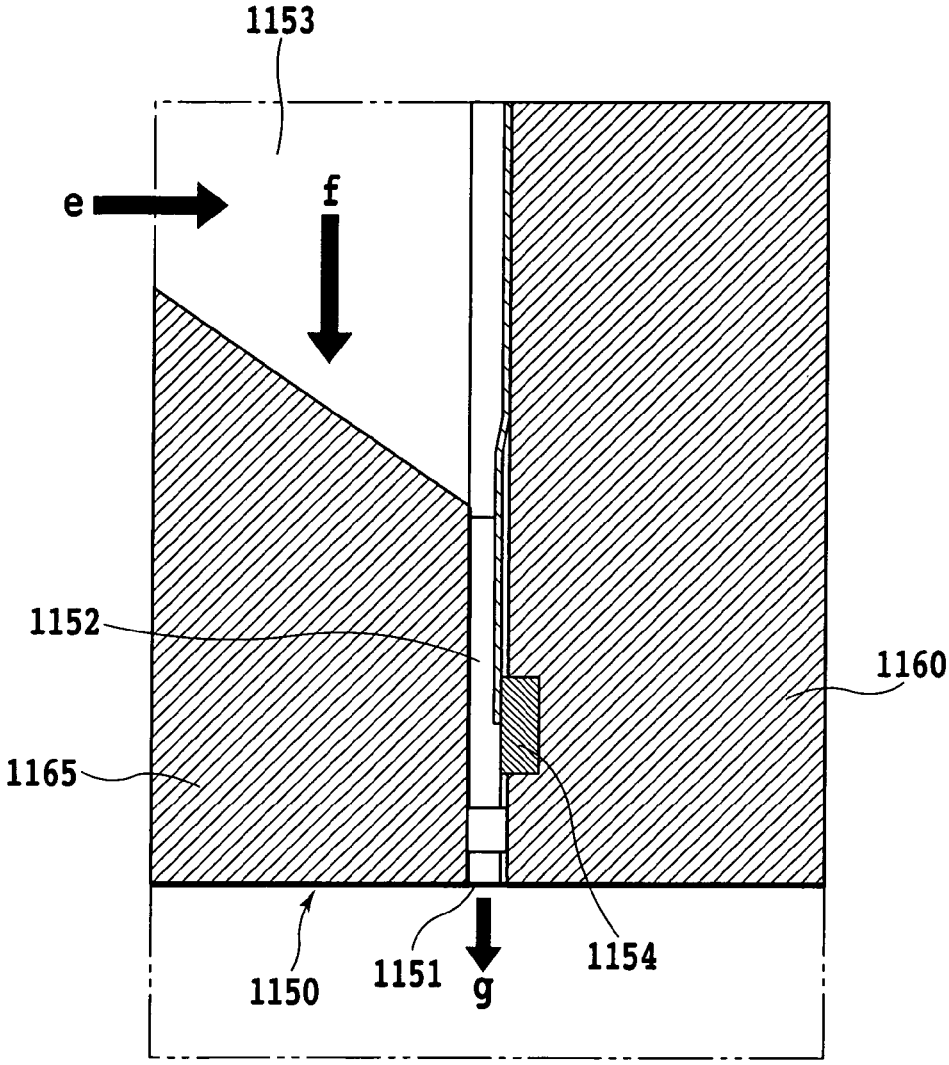
FIG. 16 is an enlarged view of a rectangular part shown by an arrow XVI in FIG. 15.
Figure 17:
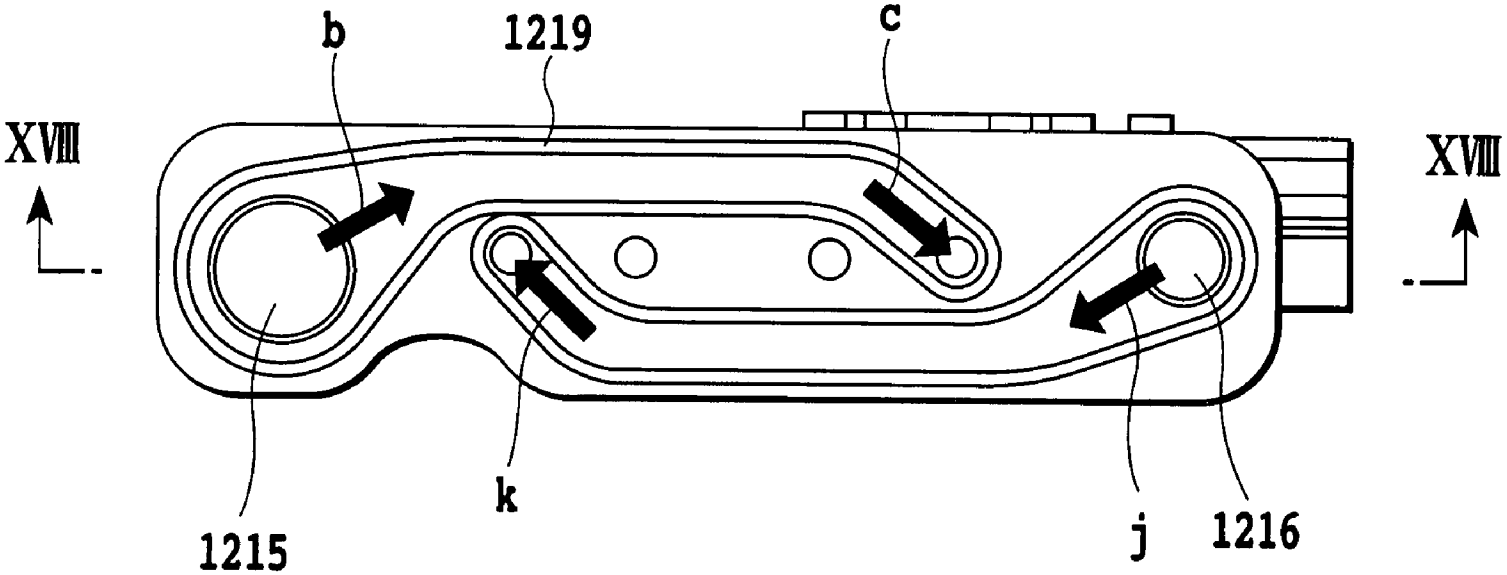
FIG. 17 is a plan view illustrating the internal structure of a joint portion in the print head in FIG. 12.
Figure 18:
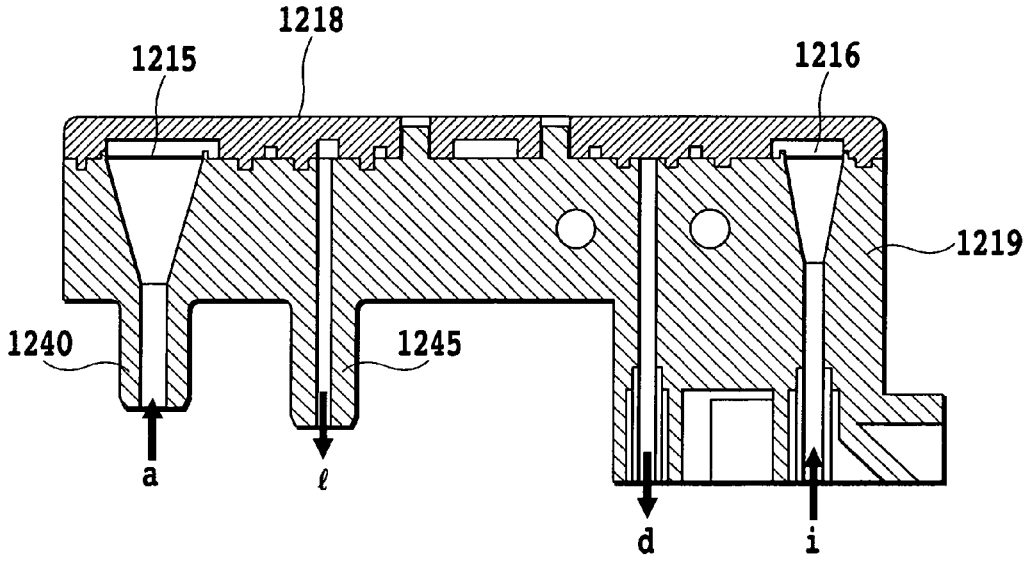
FIG. 18 is a sectional view taken along line XVIII-XVIII in FIG. 17.

FIG. 11 is a block diagram showing an essential part of a control system in the printing apparatus 1000.

The printing apparatus 1000 is connected to an external apparatus (host apparatus) 101 such as a computer by an interface or centronics. The printing apparatus 1000 prints an image on the basis of printing information transferred by the external apparatus 101 via a general-purpose interface. The printing information includes text code data, graphic drawing commands, image information such as image data, and apparatus control information on, for example, switching of the sheet or a sheet discharging port; the data, information, and commands are based on a predetermined printer language. The printing apparatus 1000 is provided with an operation panel 102, a control unit 103, and a sheet discharging operation device 60. The operation panel 102 is an interface to a user and is composed of various switches (buttons) used to operate the printing apparatus 1000, a display device, and the like. The display device consists of a LCD (Liquid Crystal Display) and a LED (Light Emitting Diode) display. The user can operate the operation panel 102 to instruct the printing apparatus 1000 on predetermined operations. Various pieces of information set by a use are stored in a nonvolatile memory such as NVRAM for management.

The control unit 103 is composed of a video controller 106, an engine controller 107, and an option controller 108.

The control unit 103 controls the print head 100 on the basis of print data to cause the print head 100 to eject ink to print an image on the sheet 51 as described later. A multicolor image can be printed by causing the print head 100, provided in the printing apparatus 1000, to eject inks of different colors. The printing apparatus has a plurality of ink tanks 1 (see FIG. 10) that accommodate the different color inks. The ink is rapidly consumed in those tanks which accommodate inks frequently used. Thus, the plurality of ink tanks 1 are independent of one another so that only those in which the ink has been exhausted can be replaced with new ones. The control unit 103 also has a function for controlling the ink supply device 90 as described later so as to circulate the ink in the print head 100 at predetermined periods.

The video controller 106 is connected to the external apparatus 101 by the general-purpose interface to receive print data (various PDL data and the like) transferred by the external apparatus 101. Then, on the basis of the print data, the video controller 106 generates page information consisting of dot data or the like. The video controller 106 transmits image data (binary or multivalued data) to the engine controller 107 via the video interface 109. Moreover, the video controller 106 transmits, for example, a command specifying sheet discharging to the option controller 108 via an integral interface 110. On the basis of the image data transferred by the video controller 106, the engine controller 107 prints an image using a well-known image forming process and the print head 100. Further, the engine controller 107 instructs the option controller 108 on timing for sheet discharging.

The option controller 108 comprises a CPU (Central Processing Unit), a ROM (Read Only Memory), a RAM (Random Access Memory), and the like; the CPU, ROM, and RAM are not shown in the drawings. On the basis of the sheet discharging information specifications transferred by the video controller 106 and the engine controller 107, the option controller 108 integrally controls at least one option device such as the sheet discharging option device. That is, the option controller 108 is an integral controller that integrally controls various option devices by communication with option controller units provided in the option devices via an interface 111 for the option devices. The sheet discharging option device 60 performs a sheet discharging operation on the basis of control information transmitted by the option controller 108.

Figure 1:
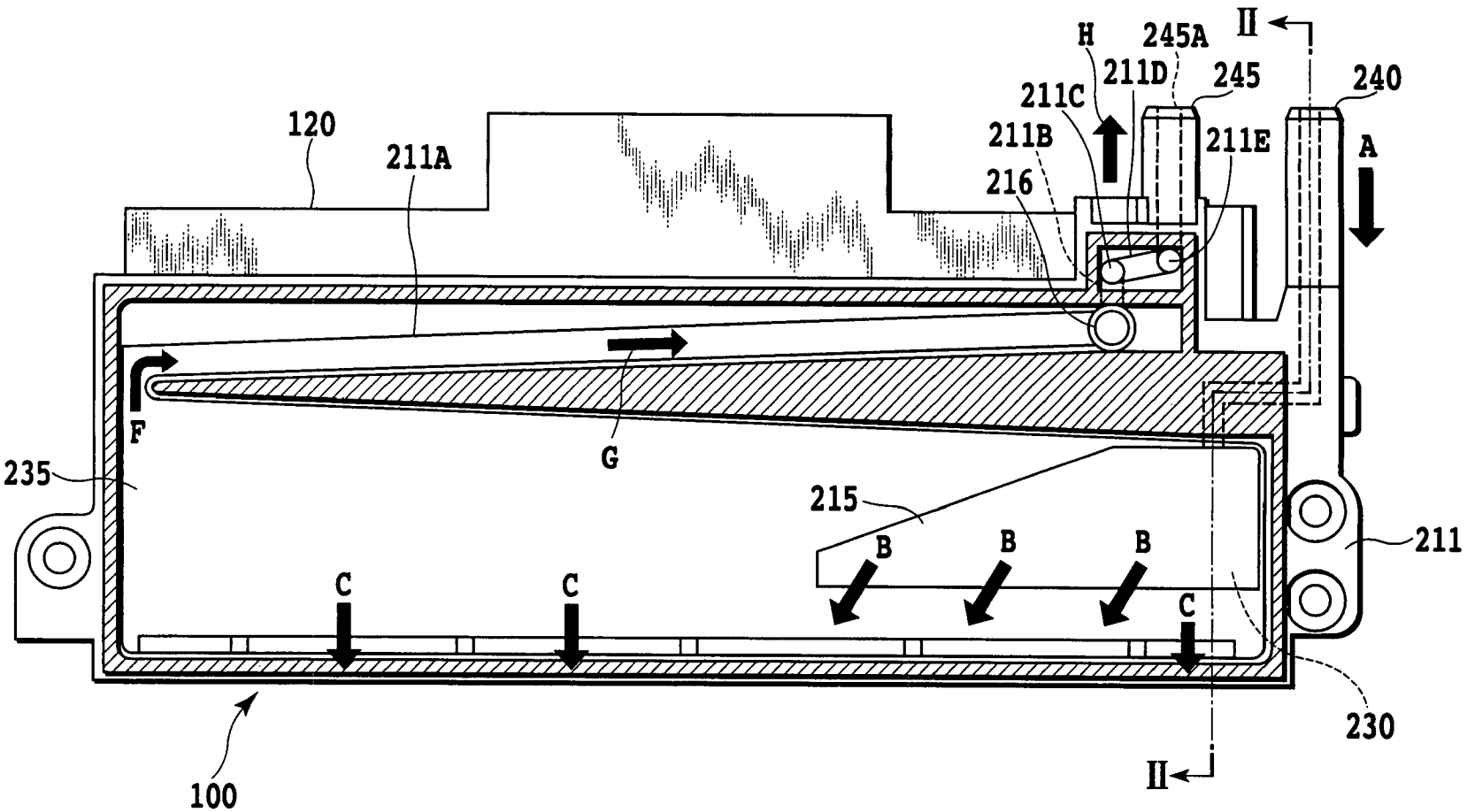
FIG. 1 is a front view of an ink storing chamber member in a print head in accordance with an embodiment of the present invention.
Figure 2:
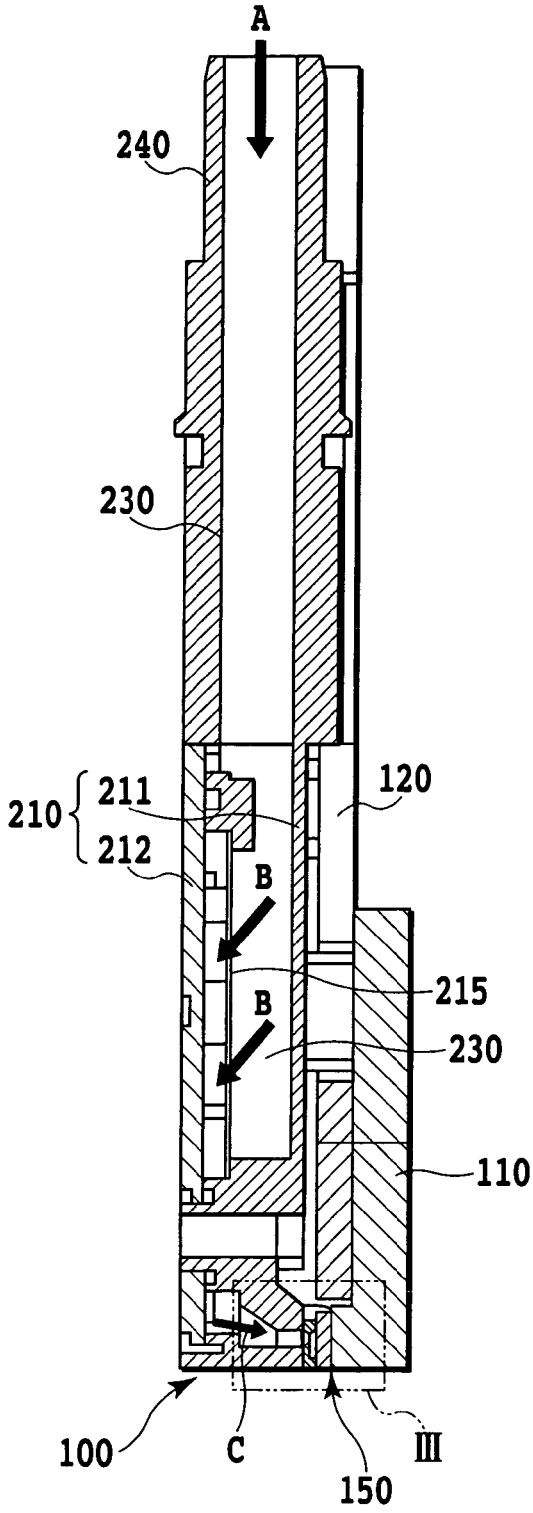
FIG. 2 is an enlarged sectional view taken along line II-II in FIG. 1.
Figure 3:
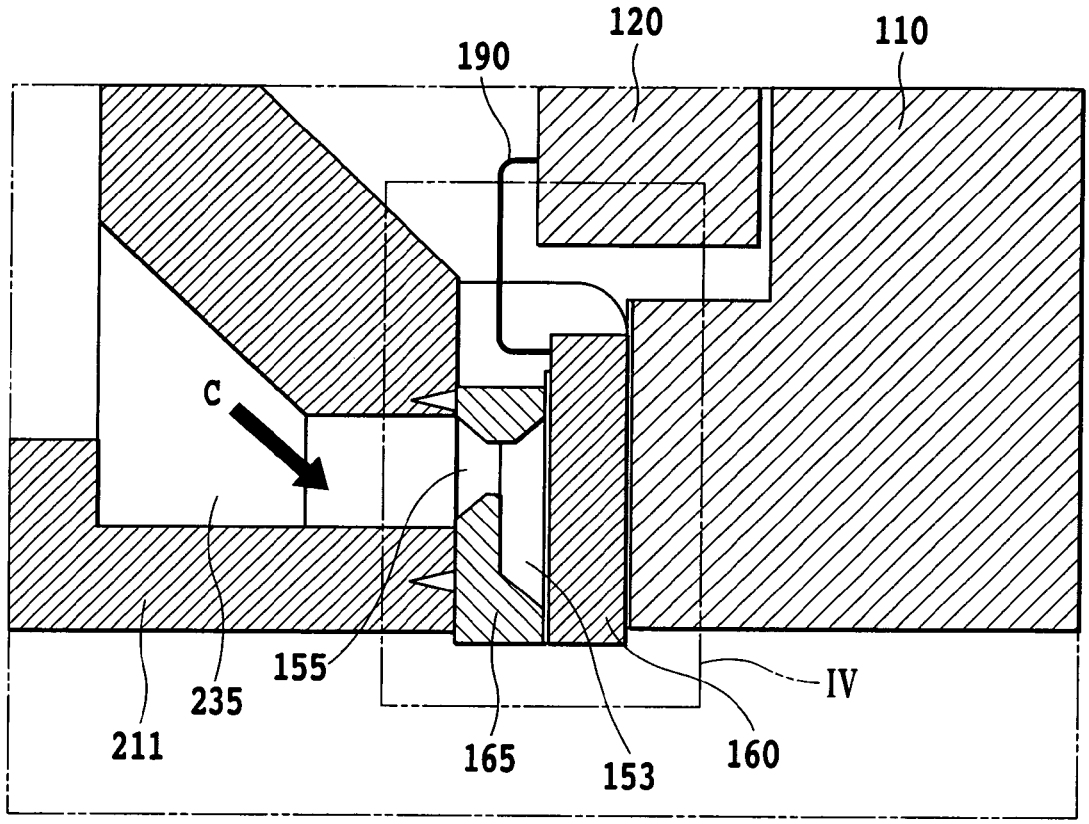
FIG. 3 is an enlarged view of a rectangular part shown by an arrow III in FIG. 2.
Figure 4:
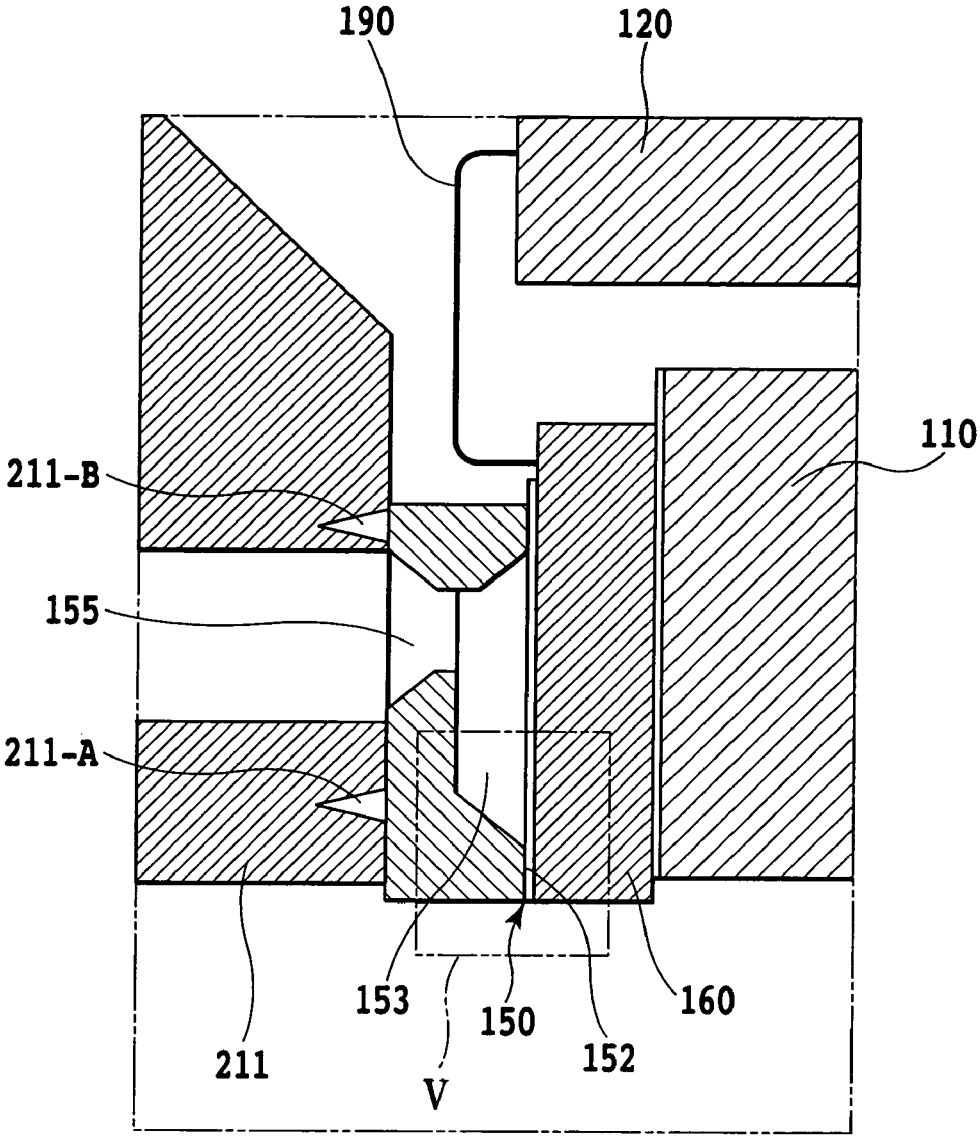
FIG. 4 is an enlarged view of a rectangular part shown by an arrow IV in FIG. 3.
Figure 5:
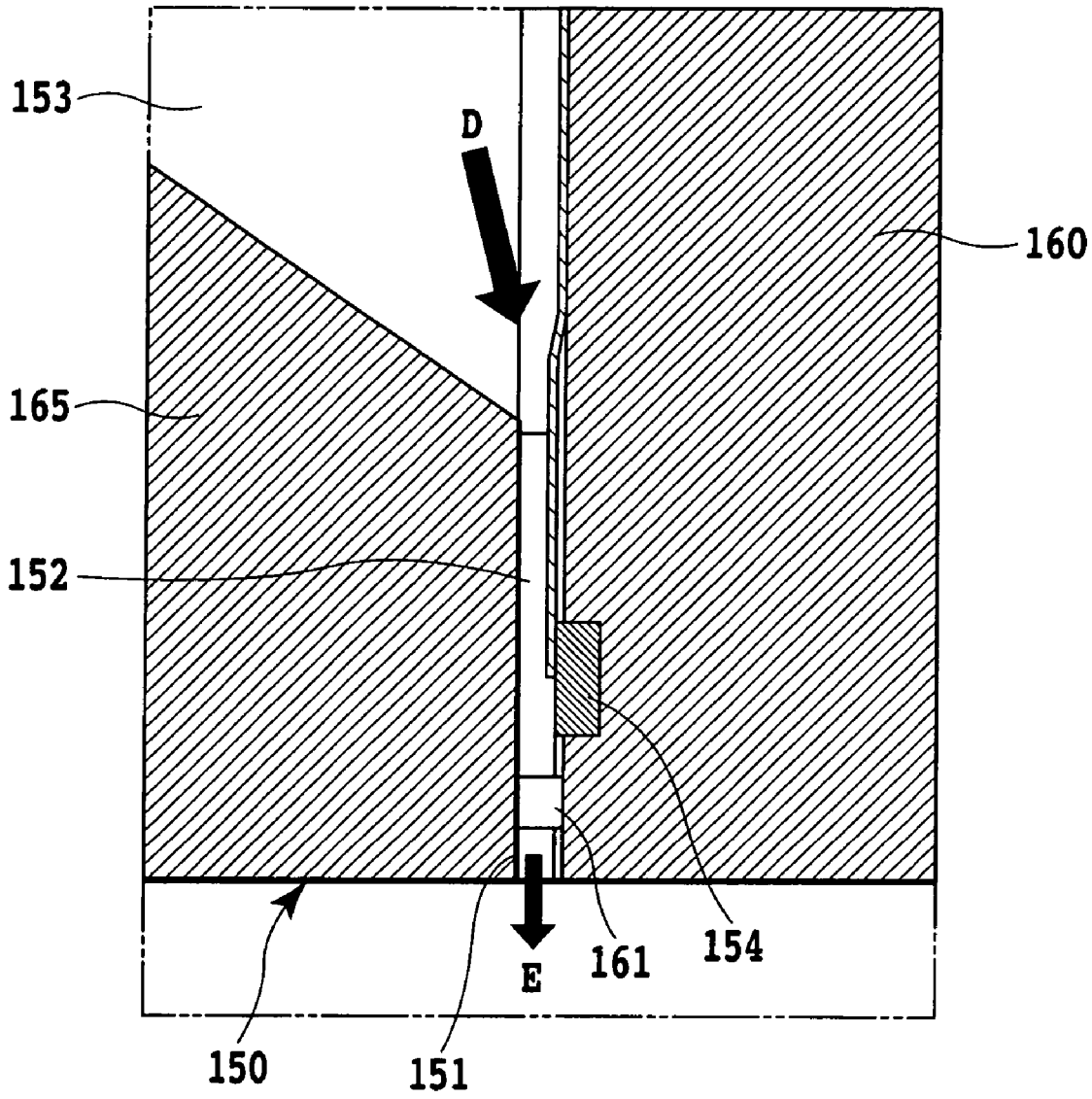
FIG. 5 is an enlarged view of a rectangular part shown by an arrow V in FIG. 4.
Figure 6:
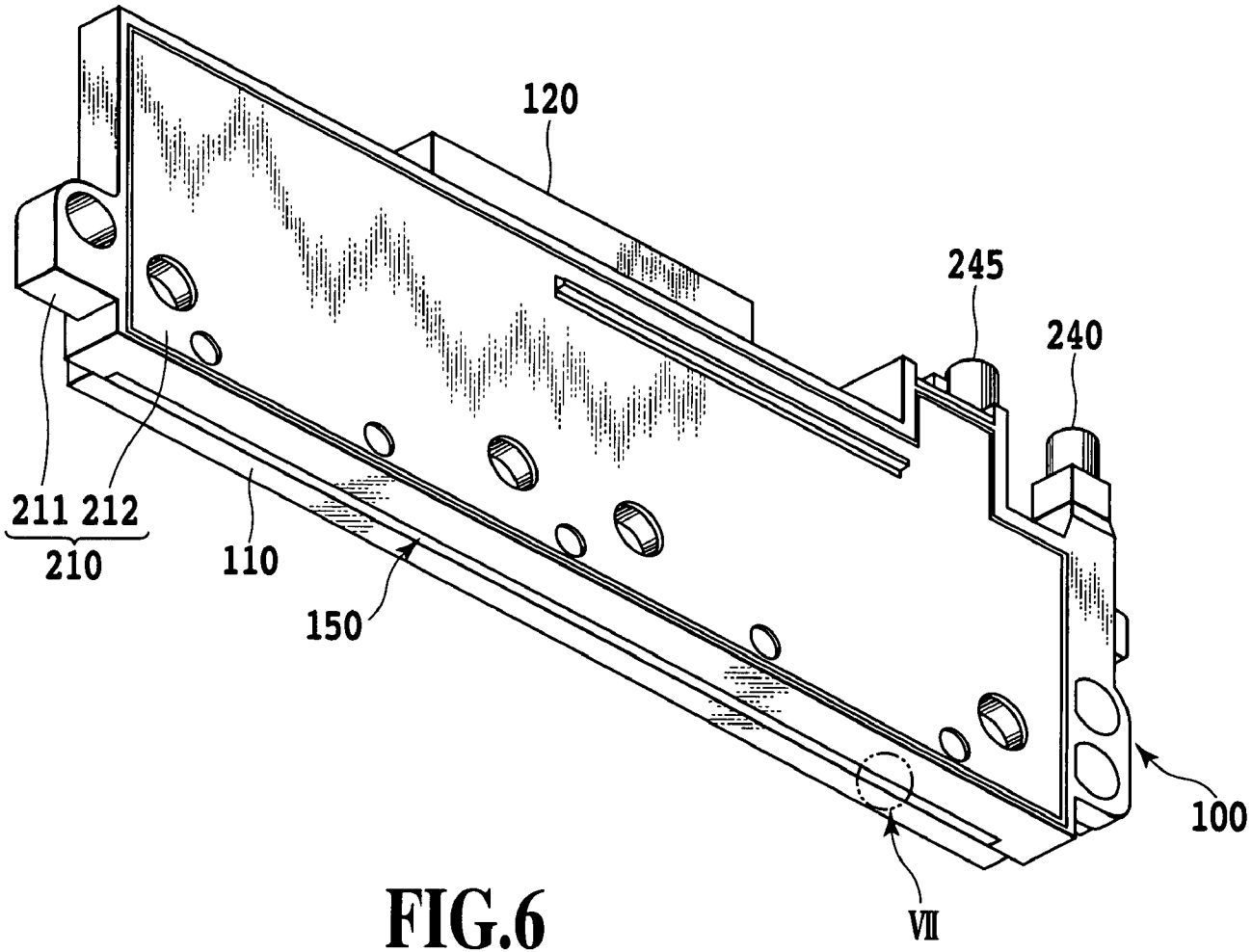
FIG. 6 is a perspective view of the print head in FIG. 1.
Figure 7:
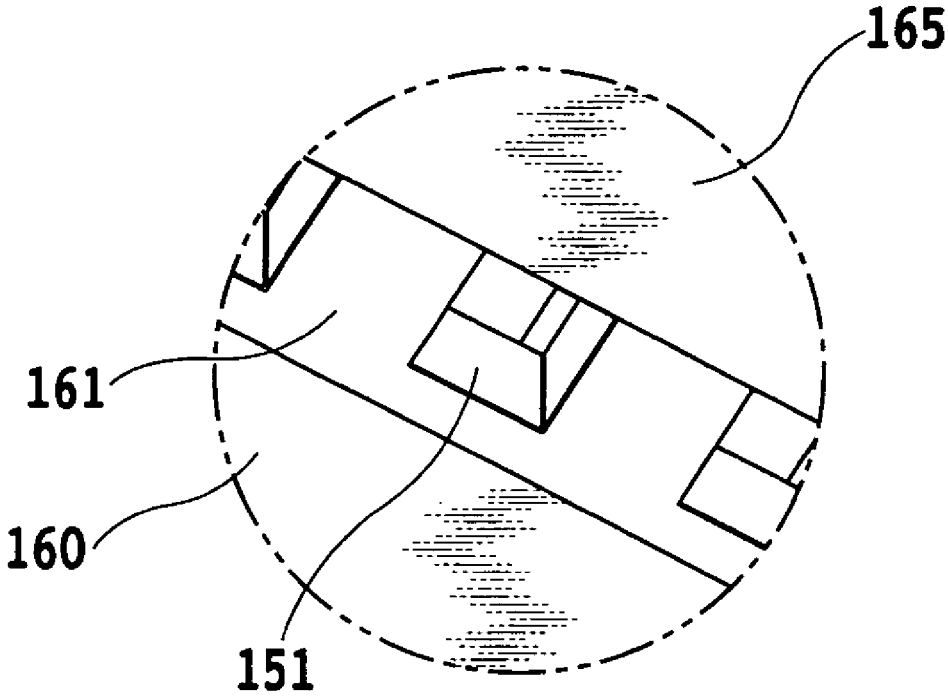
FIG. 7 is an enlarged view of a circular part VII in FIG. 6.
Figure 8:
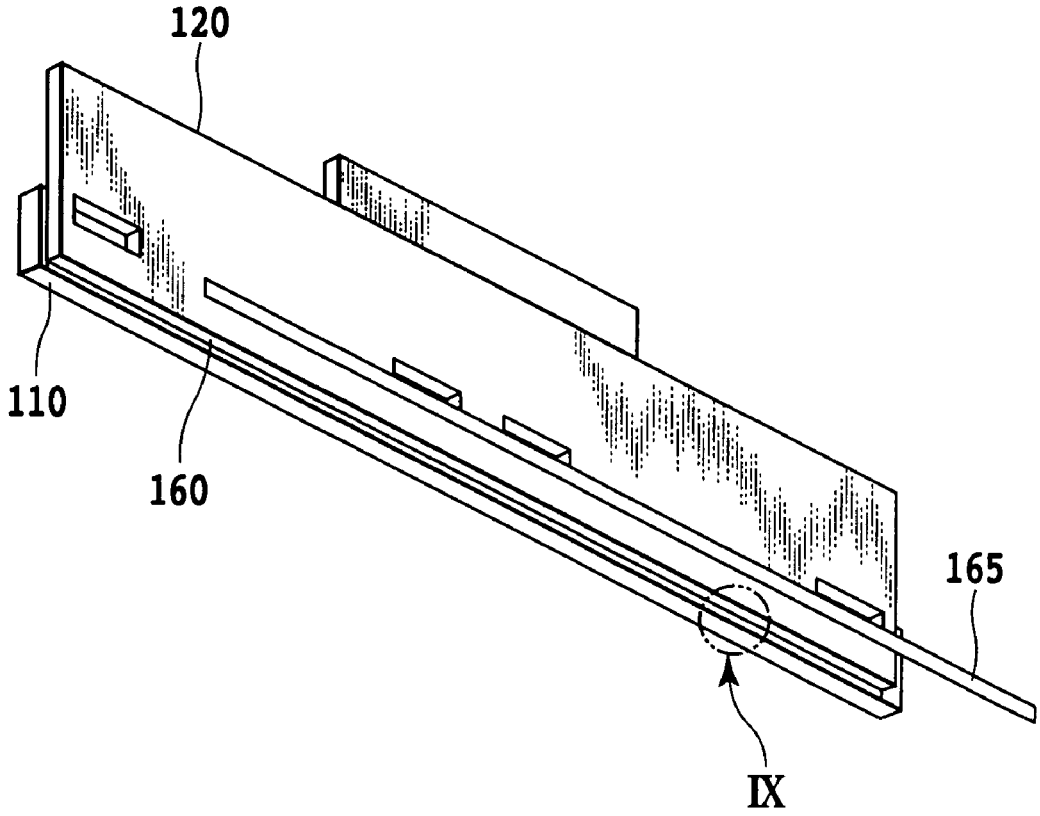
FIG. 8 is an exploded perspective view of an electric wiring board and a top board in the print head in FIG. 1.
Figure 9:
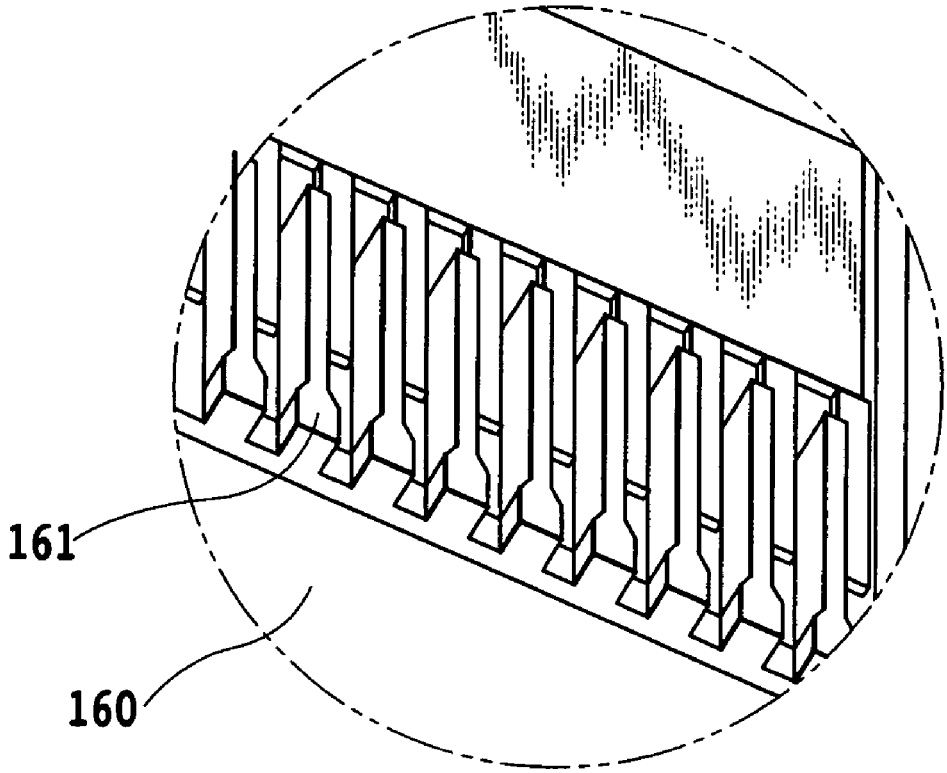
FIG. 9 is an enlarged view of a circular part IX in FIG. 8.

FIG. 1 is a front view of interior of the print head 100 from which an ink channel cover member 212 described later has been removed. FIG. 2 is an enlarged sectional view taken along line II-II in FIG. 1. FIG. 3 is an enlarged view of a rectangular part shown by an arrow III in FIG. 2. FIG. 4 is an enlarged view of a rectangular part shown by an arrow IV in FIG. 3. FIG. 5 is an enlarged view of a rectangular part shown by an arrow V in FIG. 4. FIG. 6 is a perspective view of the print head 100 as viewed from the ink channel cover member 212. FIG. 7 is an enlarged view of a circular part VII in FIG. 6. FIG. 8 is an exploded perspective view of a part of the print head 100. FIG. 9 is an enlarged view of a circular part IX in FIG. 8.

The print head 100 comprises an ejection element 150 (see FIGS. 4 and 5) having an ink ejecting function. The ejection element 150 includes a plurality of ejection openings 151 (see FIGS. 5 and 7) from which ink is ejected and a common liquid chamber 153 (see FIG. 5) in which ink supplied to the ejection openings 151 is stored. Moreover, the ejection element 150 includes a plurality of liquid channels 152 (see FIG. 5) through which ink from the common liquid chamber 153 is guided to the respective ejection openings 151 and energy generating elements 154 (see FIG. 5) provided in the respective liquid channels 152 to generate ink ejection energy. Ink is supplied from a supply port 155 in FIGS. 3 and 4 to the interior of the common liquid chamber 153. The energy generating elements 154 are provided in an Si (silicon single crystal) board 160, on which an ejection opening wall 161 (see FIG. 9) is formed by depositing a photosensitive resin using a film forming technique and an exposure device. An ink ejecting section is constructed by coupling the board 160 to a top board 165 obtained by subjecting an Si (silicon single crystal) member to an anisotropic etching process. FIG. 8 is an exploded perspective view of the top board 165 and the board 160.

The ejection element 150 is positioned on the ceramic plate 110, made of a material such as alumina (Ar20-3) which has a small coefficient of linear expansion as shown in FIGS. 2 and 3. The ceramic plate 110 serves to radiate thermal energy generated by the energy generating elements 154 (see FIG. 5) in the ejection element 150 but not utilized for ink ejection. The ejection element 150 is precisely positioned on and fixed to the ceramic plate 110. The ejection element 150 and the ceramic plate 110 are fixed together using, for example, a thermosetting bonding agent. The bonding agent makes it possible to transmit, to the ceramic plate 110, thermal energy from the ejection element 150 which is not utilized for ink ejection. For example, Ag (silver) mixed adhesive can be used as the bonding agent. In this case, to harden the Ag (silver) mixed agent applied to the bonded surfaces of the ejection element 150 and ceramic plate 110, the ejection element 150 and ceramic plate 110 are introduced and sintered in a temperature furnace. This completes fixing the ejection element 150 to the ceramic plate 110.

The electric wiring board 120 (see FIG. 4) supplies electric energy to the energy generating elements 154 (see FIG. 5) in the ejection element 150. A plurality of wiring patterns are formed on the electric wiring board 120. Storage elements to which data can be written are mounted on the electric wiring board 120. The electric wiring board 120 is attached to the aggregate of the ejection element 150 and ceramic plate 110. The electric wiring board 120 is electrically connected to the ejection element 150 by an electric wire 190 (see FIG. 4).

An ink passage through which ink is supplied to the ejection element 150 is formed of an ink passage member 211 and an ink passage cover member 212 as shown in FIG. 2. FIG. 1 is a front view of the storing chamber member 211 from which the storing chamber cover member 212 has been removed. Shaded portions in FIG. 1 correspond to surfaces of the storing chamber member 211 which are joined to the storing chamber cover member 212. In the present example, the joining surfaces are located in the same plane. A material for the members 211 and 212 has only to avoid generating precipitates that adversely affect the energy generating elements 154 in the ejection element 150. That is, the material has only to avoid adversely affecting the energy generating elements 154 when the members 211 and 212 are immersed in ink used for the print head 100 in a high-temperature and high-pressure environment. An inlet filter 215 and an outlet filter 216 in FIG. 1 are provided to remove rubbish or dust from the ink. The inlet filter 215 in the present example is composed of metal fibers interwoven so as to form 8×8 μm squares. The filter 215 thus traps rubbish of up to 8×8 μm. In the present example, the rectangular inlet filter 215 and the outlet filter 216 are thermally welded to fixed positions in the storing chamber member 215 as shown in FIG. 1; the outlet filter 216 appears circular in a plan view.

Ink supplied to the common liquid chamber 153 passes through the inlet filter 215. The inlet filter 215 must be set to occupy an area that does not hinder the flow of ink when the ink ejection speed of the print head 100 is increased. That is, the inlet filter 215 desirably has a large area. When ink is supplied to the interior of the print head 100, air in the print head 100 is discharged through the outlet filter 216. Thus, the outlet filter 216 is set to occupy a small area so that pressure is exerted on the entire surface of the filter.

The inlet filter 215 is attached to the storing chamber member 211 to form first and second ink storing chambers 235 and 230 extending across the thickness of the storing chamber member 211. That is, the first ink storing chamber 235 is formed in front of the inlet filter 215 in the sheet of the drawing in FIG. 1 (left of FIG. 2). Further, the second ink storing chamber 230 is formed behind the inlet filter 215 in the sheet of the drawing in FIG. 1 (right of FIG. 2). In the present example, an opening in the ink storing chamber 230 that opens toward the first ink storing chamber 235 appears trapezoidal in a plan view. The inlet filter 215, which appears trapezoidal in a plan view, is attached to the opening as shown in FIG. 1; the inlet filter 215 has the same shape as that of the opening. The maximum size of the opening in the ink storing chamber 235 that opens toward the second ink storing chamber 230 can be set equal to the area of the first storing chamber 235. The area of the inlet filter 215 can be set larger in accordance with the size of the opening in the ink storing chamber 235. That is, the area of the inlet filter 215 can be set as large as possible provided that the inlet filter 215 can be accommodated in the first ink storing chamber 235.

An ink storing chamber case 210 is completed by joining the storing chamber cover member 212 to the storing chamber member 211 to which the filters 215 and 216 have been attached. In the present example, the storing chamber cover member 212 is bonded with an adhesive to the joining surface of the storing chamber member 211 which is shaded in FIG. 1. That is, a pressure type fluid coating applicator mounted on a tri-axial driving robot is used to apply a thermoplastic adhesive to predetermined grooves formed in the joining surface of the storing chamber member 211. Then, the storing chamber cover member 212 is bonded to the storing chamber member 211. The type of the adhesive and the applying method are not limited to the above.

The storing chamber case 210 is attached to the aggregate of the ejection element 150 and ceramic plate 110 and to the electric wiring board 120.

An ink supply port 155 is formed in the top board 165 of the ejection element 150 as shown in FIG. 4. Application grooves 211-A and 211-B for a sealing adhesive are formed around the periphery of a part of the storing chamber member 211 of the storing chamber case 210 which is in communication with the ink supply port 155 as shown in FIG. 4. In the present example, the application grooves 211-A and 211-B have a triangular cross section but may have a semicircular or any other cross section. Grooves similar to the application grooves 211-A and 211-B may be formed around the periphery of the ink supply port 155, which is joined to the storing chamber member 211. Further, if the bonding and sealing adhesive is applied to the ejection element 150, which is then joined to the storing chamber member 211 of the storing chamber case 210, it enters the grooves 211-A and 211-B and is hindered from flowing toward the ink supply port 155. The grooves 211-A and 211-B must be formed so as to preclude air from being collected inside the grooves.

One-component thermosetting adhesive 4402 (manufactured by Dow Corning Toray Co., Ltd.) may be used as the adhesive. When this bonding and sealing adhesive was applied to the ejection element 150, it was confirmed not to drift. Preferable candidates for the adhesive have a high viscosity (for SE4402, 33 Pa·s) and a high thixotropy property. In view of operability, the use of such a one-component thermosetting adhesive makes it possible to reduce the time and effort required for the maintenance or replacement of the adhesive applicator resulting from the hardening of the adhesive.

The storing chamber case 210 is aligned with and joined to the ejection element 150. The storing chamber case 210 and the ejection element 150 are then pressed in the respective joining directions. Then, the adhesive flows into the grooves 211-A and 211-B. This makes it possible to prevent the adhesive from flowing out toward the ink supply port 155 or the ink ejection port 151. In the present example, the ejection element 150 is positioned on and temporarily fixed to the storing chamber case 210. Then, the ejection element 150 and the storing chamber case 210 are placed in a furnace set at a temperature between 120 and 150° C. and are heated and hardened. The heating temperature is set in accordance with the heat resistant temperatures of parts used. With the print head in the present example, the storing chamber case 210 has the lowest heat resistant temperature and can stably maintain its mechanical performance up to 150° C. Accordingly, the heating temperature was set at 120° C. Such heating for about two hours hardens the adhesive to form an ink channel. A print head is thus completed.

With the print head configured as described above, the direction in which the components are assembled can be set to one of the rightward and leftward directions in FIG. 2. That is, the print head can be assembled from one direction. The print head can be assembled without changing the assembling direction.

The ink flow in the print head is formed as described below.

Ink supplied by an external ink supply device is introduced into a joint 240 serving as an ink introducing section of the print head 100. The ink then flows in the direction of an arrow A in FIG. 2 and is then introduced into the second ink storing chamber 230. The ink in the second ink storing chamber 230 flows through the inlet filter 215 into the first ink storing chamber 235 as shown by an arrow B in FIGS. 1 and 2. The ink is provided to the interior of the common liquid chamber 155 along the direction of an arrow C in FIG. 3. The ink is further introduced into the liquid channel 152 along the direction of an arrow D in FIG. 5. The ink in the liquid channel 152 is ejected from the ejection openings 151 in the direction of an arrow E when the energy generating elements 154 generate ejection energy on the basis of print data. The ejected ink is applied to the sheet 51 to print an image.

Electrothermal converters (heaters) or piezo elements may be used as the energy generating elements. The electrothermal converters generate heat to bubble the ink in the liquid channel 152. The bubbling energy is utilized to enable the ink to be ejected through the ejection openings 151.

The ink channel from the joint 240 to the common liquid chamber 155 has less bent portions than the ink channel in the print head in the conventional example. In the present print head, ink can thus be supplied more smoothly. Further, most of the ink channel extends from top to bottom and few parts of the ink channel extend in the lateral direction. This serves to reduce ink flow resistance. Furthermore, the first ink storing chamber 235 supplies ink directly to the interior of the common liquid chamber 155. Moreover, the inlet filter 215 is provided between the first and second ink storing chambers 235 and 230 and is set to occupy a large area. This reduces the ink flow resistance to enable the smooth supply of the ink. It is thus possible to set the ejection driving frequency for the ejection of ink from the ejection openings 151 at a large value to increase the printing speed.

Ink not supplied from the first ink storing chamber 235 to the common liquid chamber 155 flows from the direction of an arrow F-in FIG. 1 into the ink channel 211A, leading to the outlet filter 216. The ink then flows through the ink channel 211A in the direction of an arrow G in FIG. 1. The ink then flows through the outlet filter 216 and is discharged from the joint 245, an ink output section of the print head 100, in the direction of an arrow H in FIG. 1.

That is, the storing chamber member 211 is provided with a output port 211C that is in communication with the ink channel 211A through the channel 211B, located away from the reader in the sheet of FIG. 1, an input port 211E that is in communication with an ink channel 245A located inside the joint 245, and a groove 211D positioned between the output port 211C and the input port 211E. The storing chamber member 211 and the storing chamber cover member 212 are joined together so that the groove 211D forms an ink channel that allows the output port 211 C to communicate with the input port 211E in a liquid tight manner. Consequently, ink having passed through the inlet filter 216 passes through the ink channel 211B, output port 211C, groove 211D, and input port 211E. The ink is then discharged in the direction of an arrow H through the ink channel 245A in the joint 245.

When the print head 100 configured as described above is used to print information received from the external apparatus 101 in FIG. 11 and containing texts, images, and the like, the control unit 103 first receives print information and executes required calculations. Subsequently, the control unit 103 gives a heating instruction to the silicon board 160, comprising the energy generating elements 154, via the electric wiring board 120 in the print head 100. The control unit 103 thus causes the energy generating elements 154 to generate heat to bubble the ink on the energy generating elements 154. The ink is thus ejected from the corresponding ink ejection openings 151. Then, an image containing characters, images, or the like can be printed by applying the ink to the sheet 51.

If such a printing operation is continuously performed, the heat generation energy required to eject ink is accumulated in the ink. Thus, the temperature of the ink in the print head 100 may rise to cause a gas dissolved in the ink to appear as bubbles. If the ink on the energy generating elements 154 is ejected with bubbles remaining in the ink, the ink is incompletely bubbled when the energy generating elements 154 generate heat. In this case, the ink may not be ejected from the ejection openings, thus precluding a favorable image from being printed. Thus, the ink supply device 90 periodically circulates the ink between the interior and exterior of the print head 100 to remove bubbles from the print head 100.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes.

What is claimed is:

1. An ink print head in which ink is supplied from an ink introducing section to a common liquid chamber through an ink storing chamber and in which the ink supplied to the common liquid chamber can be ejected from ejection openings, the print head comprising:

a first storing chamber member and a second storing chamber member which are joined together to form the ink storing chamber;

a filter partitioning the ink storing chamber into a first ink storing chamber located on the first storing chamber member side and a second ink storing chamber located on the second storing chamber member side;

an ink output section formed in the second storing chamber member, the ink output section being able to discharge the ink in the first ink storing chamber to an exterior; and an outlet filter attached to the second storing chamber member, ink discharged from the output section flowing through the outlet filter, wherein the common liquid chamber and the ejection openings are formed in the second storing chamber member, the ink introducing section is formed in the second storing chamber member, and the ink introduced from the ink introducing section to the second ink storing chamber is supplied to the common liquid chamber through the filter and the first ink storing chamber.

2. The ink jet print head according to claim 1, wherein the second ink storing chamber is formed between one side of the filter and the second storing chamber member by attaching the filter to the second storing chamber member, and the first ink storing chamber is formed between the other side of the filter and the first storing chamber member by joining the first and second storing chamber members.

3. The ink jet print head according to claim 1, further comprising an ink channel that communicates between the first ink storing chamber and the ink output section, the ink channel being formed by joining the first and second storing chamber members.

4. The ink jet print head according to claim 1, wherein the first ink storing chamber is located above the common liquid chamber, and the first and second ink storing chambers are partitioned with the filter so as to be arranged in a horizontal direction.

5. The ink jet print head according to claim 1, wherein joining surfaces of the first and second storing chamber members are located in the same plane.

6. The ink jet print head according to claim 1, wherein the first and second storing chamber members are bonded together using an adhesive.

7. An ink jet printing apparatus comprising:

moving means for causing relative movement between the ink jet print head according to any one of claims 1, 2, 3 and 4-6 and a print medium;

ink supplying means for supplying ink to the ink introducing section of the ink jet print head; and control means for ejecting ink from the ejection openings in the ink jet print head.

8. An ink jet print head in which ink is supplied from an ink introducing section to a common liquid chamber through an ink storing chamber and in which the ink supplied to the common liquid chamber can be ejected from ejection openings, the print head comprising:

a filter partitioning the ink storing chamber into a first ink storing chamber communicating with the common liquid chamber and a second ink storing chamber communicating with the ink introducing section;

an ink output section communicating with the first ink storing chamber, the ink output section being able to discharge the ink in the first ink storing chamber to an exterior; and an outlet filter through which the ink in the first ink storing chamber is discharged from the output section, wherein the ink introduced from the ink introducing section to the second ink storing chamber is supplied to the common liquid chamber through the filter and the first ink storing chamber.

* * * * *